US005314008A

United States Patent [19]

Garcia-Mallol

[11] Patent Number: 5,314,008

[45] Date of Patent: May 24, 1994

[54] FLUID-COOLED JACKET FOR AN AIR-SWEPT DISTRIBUTOR

[75] Inventor: Juan A. Garcia-Mallol, Morristown, N.J.

[73] Assignee: Foster Wheeler Energy Corporation, Clinton, N.J.

[21] Appl. No.: 886,894

[22] Filed: May 22, 1992

[51] Int. Cl.[5] ..... F23K 3/00; F28F 3/12

[52] U.S. Cl. ..... 165/47

[58] Field of Search ..... 165/47, 920, 168, 169; 110/264; 431/160; 122/6 A

[56] References Cited

U.S. PATENT DOCUMENTS

| | | | |
|---|---|---|---|
| 1,242,114 | 10/1917 | Richardson et al. | 431/160 |
| 2,209,561 | 7/1940 | Curtis | 165/169 |
| 2,697,598 | 12/1954 | Affleck | 165/169 |
| 2,891,320 | 6/1959 | Buff | 165/168 |
| 3,100,461 | 8/1963 | Werner | 431/160 |
| 3,224,501 | 12/1965 | Burdick et al. | 165/169 |
| 3,295,172 | 1/1967 | Dain | 165/169 |
| 3,677,327 | 7/1972 | Vartiainen | 165/169 |
| 4,422,624 | 12/1983 | Dunham et al. | 431/160 |
| 4,887,962 | 12/1989 | Hasenach et al. | 431/160 |

FOREIGN PATENT DOCUMENTS

| | | | |
|---|---|---|---|
| 508974 | 7/1953 | Belgium | 110/264 |

*Primary Examiner*—John K. Ford
*Attorney, Agent, or Firm*—Marvin A. Naigur

[57] ABSTRACT

A fluid-cooled jacket formed by a plurality of panels surrounding and cooling the inlet portion of an air-swept distributor, a component of a fluidized bed reactor system. Each panel contains inlet and outlet tubes, inlet and outlet headers, and a heat exchange portion partitioned to direct the fluid flow through the heat exchange portion. The heat dissipated from the reactor is extracted to prevent the temperature of the entire distributor and the fuel from rising, which allows the use of fuels having a lower temperature softening point.

1 Claim, 1 Drawing Sheet

FLUID-COOLED JACKET FOR AN AIR-SWEPT DISTRIBUTOR

BACKGROUND OF THE INVENTION

This invention relates to a fluid-cooled jacket and, more particularly, to a fluid-cooled jacket for an air-swept distributor for particulate solid materials.

Fluidized bed reactors, such as combusters, steam generators, and gasifiers are well known. In these arrangements, air is passed through a bed of particulate materials, including a fossil fuel such as coal and an adsorbent for the sulfur generated as a result of the combustion of the coal, to fluidize the bed and to promote the combustion of the fuel at a relatively low temperature. When the heat produced by the fluidized bed is utilized to convert water to steam, such as in a steam generator, the fluidized bed system offers an attractive combination of high heat release, high sulfur adsorption, low nitrogen oxide emissions, and fuel flexibility.

The particulate fossil fuel combusted in these fluidized bed reactors is supplied to the reactor by a distributor which transports the particulate fuel from the fuel supply to the fluidized bed reactor. The particular design of the distributor controls the flow characteristics of the fuel.

Utilization of fluidized bed reactors has increased with their ability to combust lower heating value fuels, which often have a relatively higher moisture level and a lower temperature softening point. The higher moisture level in the fuel causes increased adhesiveness, which makes these fuels difficult to transport. Therefore, air-swept distributors have been utilized, since they provide efficient, low-cost, low-maintenance transportation of these relatively high moisture-level fuels.

However, when the temperature of the air-swept distributor causes the fuel to be heated above its softening point, the adhesive qualities of the fuel are dramatically increased, which severely curtails fuel transportation through the distributor. Also, if the air-swept distributor is heated to such a high temperature that the fuel will stick and then burn in the distributor, the distributor would be damaged.

SUMMARY OF THE INVENTION

It is therefore an object of the present invention to provide a fluid-cooled jacket for cooling an air-swept distributor.

It is a further object of the present invention to provide a fluid-cooled jacket of the above type which cools the internal faces of an air-swept distributor.

It is a further object of the present invention to provide a fluid-cooled jacket of the above type which can utilize a variety of fluids, including water, steam, or a combination thereof, to cool the internal faces of an air-swept distributor.

It is a further object of the present invention to provide a fluid-cooled jacket of the above type which reduces the internal face temperature of the distributor to such a level that the distributor can accommodate low temperature-softening point fuels without the occurrence of sticking or burning.

It is a further object of the present invention to provide a fluid-cooled jacket of the above type which reduces the internal face temperature of an air-swept distributor and maintains the lower temperature, which increases the number of fuels available for use in the above-mentioned fluidized bed reactors.

Toward the fulfillment of these and other objects, the fluid-cooled jacket of the present invention encompasses the exterior surface area of the inlet portion of an air-swept distributor for a fluidized bed reactor. The fluid-cooled jacket consists of four rectangularly-shaped panels arranged so as to surround the rectangularly-shaped distributor. The fluid is passed independently through each of the four panels to cool the distributor. Each panel has a fluid inlet tube, an inlet header, a heat exchange portion, an outlet header, and a fluid outlet tube. By cooling the inlet portion of the distributor, the entire distributor will remain relatively cool and eliminate the above problems.

DESCRIPTION OF THE DRAWINGS

The above description, as well as further objects, features, and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
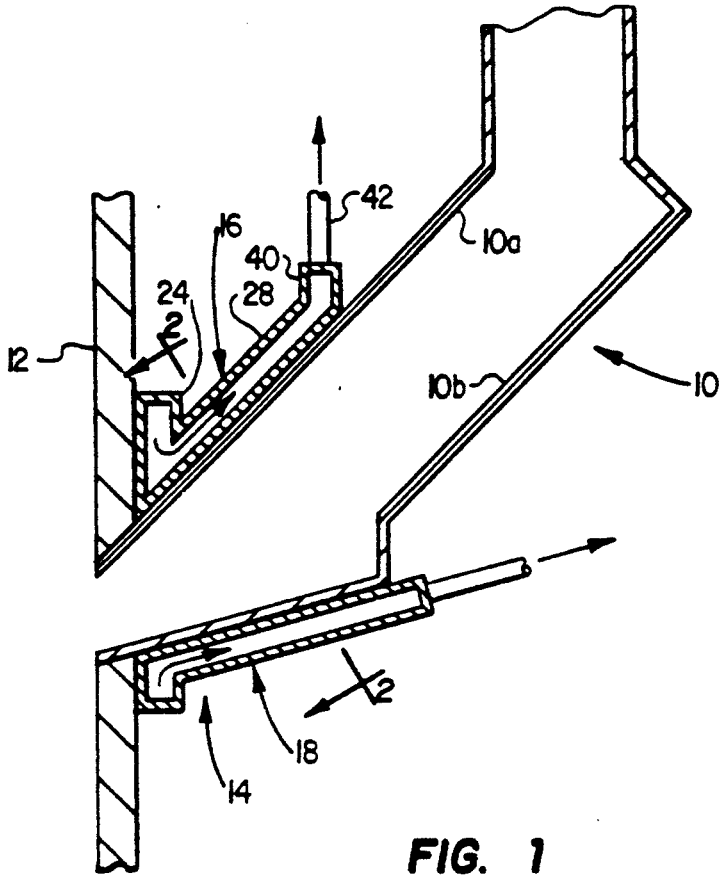
FIG. 1 is a cross-sectional side view of the fluid-cooled jacket of the present invention.
Figure 2:
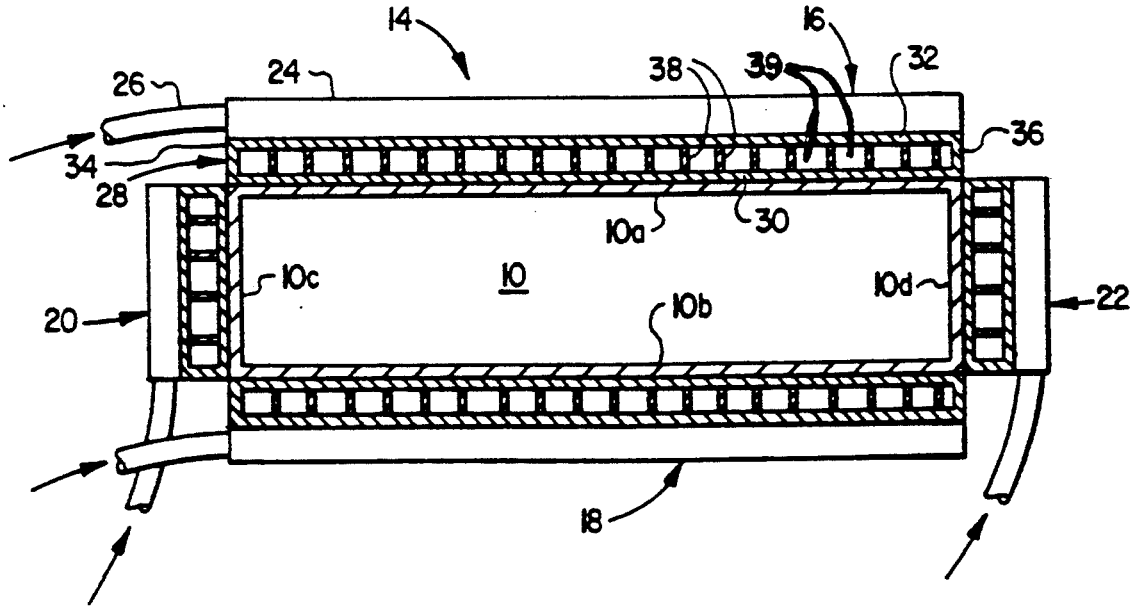
FIG. 2 is a cross-sectional view taken along the line 2—2 of FIG. 1.

Referring to FIGS. 1 and 2 of the drawings, the reference numeral 10 refers, in general, to a distributor which includes a top plate 10*a*, a bottom plate 10*b*, and two side plates 10*c* and 10*d*. The distributor 10 transports fuel from a fuel supply (not shown) to the furnace section of a fluidized bed reactor, with a portion of a wall of the furnace section being referred to by the reference numeral 12. The fluid-cooled jacket of the present invention is shown in general by the reference number 14 and surrounds a portion of the distributor 10.

FIG. 2 illustrates a top panel 16, a bottom panel 18, and two side panels 20 and 22 which together constitute the fluid-cooled jacket 14. The panels 16, 18, 20, and 22 extend over the top plate 10*a*, the bottom plate 10*b*, and the side plates 10*c* and 1O*d*, respectively, and thus surround the lower end portion of the distributor 10 as viewed in FIG. 1.

The top panel 16 is hollow and includes an inlet header 24 to which an inlet tube 26 is connected. The inlet header 24 extends the full width of the top plate 10*a* and is integrated with, and in fluid communication with, a heat exchange portion 28, which also extends the full width of top plate 10*a*. Relative to the distributor 10, the heat exchange portion 28 includes an inner plate 30 resting on the outer surface of the top plate 10*a*, a spaced outer plate 32, and two spaced side plates 34 and 36, which plates are connected in any known manner to form a hollow structure. The heat exchange portion 28 is divided by a plurality of evenly, spaced parallel partitions 38 to define a plurality of heat exchange channels 39, which are oriented to extend from the inner plate 30 to the outer plate 32 and along the longitudinal axis of the distributor 10 to channel the fluid flow through the heat exchange portion 28. The heat exchange portion 28 abuts and is connected to the distributor 10 in any known manner and is integrated with, and in fluid communication with, an outlet header 40 (FIG. 1). The inlet header 24 and the outlet header 40 are the same width as heat exchange portion 28 but do not have any partitions. The outlet header 40 is connected to, and in fluid communication with, an outlet tube 42.

The panels 18, 20, and 22 are configured and constructed in the same manner as top panel 16, relative to the distributor 10 (FIG. 2). As a result, the panels 18, 20, and 22 will not be discussed further.

In operation, a cooling fluid, such as water, steam, or a combination thereof, enters the top panel 16 through the inlet tube 26 and passes into the inlet header 24 before passing into the heat exchange portion 28. The fluid is then channeled along the longitudinal, axis of the distributor 10 through the plurality of heat exchange channels 34 formed by the partitions 38. The fluid then passes into the outlet header 40 and exits through outlet tube 42. The panels 18, 20, and 22 function in the same manner as the top panel 16, as described above and each panel functions independently of the others.

As a result of the foregoing, the fluid-cooled jacket of the present invention reduces the internal face temperature of the distributor, which allows the distributor to accommodate low temperature softening-point fuels without the fuel sticking or burning. The cooling of the distributor allows the use of a wide variety of fuels in the fluidized bed reactor.

The fluid-cooled jacket of the present invention can be varied in several respects without departing from the scope of the invention. For example, the size of the panels, the volume, direction, and velocity of the fluid flow, the number, orientation, and type of partitions, the type of fluid used to cool the distributor, and the portion of the distributor encompassed by the jacket can be varied. Also the present invention is not limited to use in connection with a distributor of fuel material to a reactor but rather can be used in connection with distributors of other particulate solid materials.

Other modifications, changes, and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluid-cooled jacket for cooling a particulate material distributor, said jacket comprising:

a plurality of hollow panels surrounding and positioned in heat exchange relation with said distributor for removing heat from said distributor, each of said panels comprising:

a plurality of partitions disposed within said panels and defining therewith a plurality of discrete channels aligned along the longitudinal axis of said distributor for receiving a cooling fluid;

an inlet header registering with each of said panels for passing said fluid simultaneously and independently through each of said panels in a single, common direction opposite the flow of said particulate material through said distributor; and an outlet header registering with each of said panels for receiving said fluid from each of said panels.

* * * * *

UNITED STATES PATENT AND TRADEMARK OFFICE

CERTIFICATE OF CORRECTION

PATENT NO. : 5,314,008

DATED : May 24, 1994

INVENTOR(S) : Juan Antonio Garcia-Mallol

It is certified that error appears in the above-indentified patent and that said Letters Patent is hereby corrected as shown below:

Column 2, line 60, after "evenly" delete comma.

Column 3, line 14, after "longitudinal" delete comma.

Column 3, line 16, "34" should be -- 39 --.

Signed and Sealed this

Sixth Day of September, 1994

*Attest:*

*Attesting Officer*

Bruce Lehman

BRUCE LEHMAN

*Commissioner of Patents and Trademarks*